US008944857B2

(12) United States Patent
Mariano et al.

(10) Patent No.: US 8,944,857 B2
(45) Date of Patent: Feb. 3, 2015

(54) POWER CONNECTORS HAVING COMMON CLIP ASSEMBLY

(71) Applicant: Apple Inc., Cupertino, CA (US)

(72) Inventors: Ricardo A. Mariano, Hayward, CA (US); Min Chul Kim, Santa Clara, CA (US); Nathan N. Ng, Fremont, CA (US)

(73) Assignee: Apple Inc., Cupertino, CA (US)

( * ) Notice: Subject to any disclaimer, the term of this patent is extended or adjusted under 35 U.S.C. 154(b) by 102 days.

(21) Appl. No.: 13/657,699

(22) Filed: Oct. 22, 2012

(65) Prior Publication Data

US 2014/0113499 A1 Apr. 24, 2014

(51) Int. Cl.
*H01R 13/502* (2006.01)

(52) U.S. Cl.
USPC ..... 439/695

(58) Field of Classification Search
USPC ..... 439/595–696, 352–360, 686, 752, 701
See application file for complete search history.

(56) References Cited

U.S. PATENT DOCUMENTS 4,984,998 A * 1/1991 Duncan et al. ..... 439/352
5,123,071 A * 6/1992 Mulholland et al. ..... 385/53
5,199,886 A * 4/1993 Patterson ..... 439/79

* cited by examiner

*Primary Examiner* — Jean F Duverne
(74) *Attorney, Agent, or Firm* — Kilpatrick Townsend & Stockton LLP

(57) ABSTRACT

Power plugs that may include portions that can be used in different regions, may provide reliable functionality, may be reliably manufactured, and have a pleasant appearance. One example may provide a power plug that has a clip assembly that may be used in different regions. Another example may provide a power plug that functions in a reliable manner by having a durable overmold. Another example may provide a power plug that may be reliably manufactured by providing a contact that eliminates the need for soldering or welding, and also provides alignment features to protect the contact during assembly. Another example may provide a power plug that has an attractive appearance by forming an overmold over an inner mold.

18 Claims, 10 Drawing Sheets

POWER CONNECTORS HAVING COMMON CLIP ASSEMBLY

BACKGROUND

Electronic devices often receive power from power adapters that receive power of a first type then convert it to a second type. For example, a power adapter may receive AC power at a first voltage and translate it to DC power at a second voltage. Prongs on a power plug for the power adapter may arranged to receive power a power outlet, such as a wall outlet. The power adapter may provide power over a specialized connector to the electronic device. Power may thus be provided from the wall outlet to the electronic device.

Different regions and counties may have individual infrastructures each having their own protocols for providing power at wall outlets. These protocols may involve different voltages being provided by the wall outlets as well as different physical connections for receiving power from the outlets. For example, the United States may use two flat prong or blade power connections to receive 110 Volts, where Europe may use round power prongs to receive 220 Volts.

Given the difference between regions, it may be difficult and time consuming to design different power connectors for each protocol. Accordingly, it may be desirable to be able use at least parts of these connectors in more than one region.

These power plugs may need to be functionally reliable. It may be very discouraging for a user to have an expensive electronic device become even temporarily unusable due to a defective power plug. Such a failure may also undermine a user's confidence in the device itself, and with the company that manufactured the device.

Also, it is often the case that many millions of devices may be manufactured, each needing a power plug. Even a small failure rate in manufacturing, or yield loss, may result in the loss of large numbers of plugs. Accordingly, it may be useful for these plugs to be designed such that they may be reliably manufactured.

Further, the appearance of these power plugs may inform a user's opinion as to the quality of not just the plug, but of the electronic device itself. A pleasant appearance may go a long way to informing user's appreciation of an electronic device as well as the levels of user satisfaction and enjoyment of the electronic device.

Thus, what is needed are power plugs that may have portions that can be used in more than one region, provide reliable functionality, may be reliably manufactured, and have a pleasant appearance.

SUMMARY

Accordingly, embodiments of the present invention may provide power plugs that may include portions that can be used in different regions, may provide reliable functionality, may be reliably manufactured, and have a pleasant appearance.

An illustrative embodiment of the present invention may provide power plugs for different regions having portions that may be reused among the different regions. For example, power plugs according to embodiments of the present invention may include a prong assembly that includes prongs for a particular region. The prong assembly may be attached to a clip assembly that may mate with a power adapter. The clip assembly may be common among multiple regions while the prong assembly is tailored for use with power outlets for a particular region.

An illustrative embodiment of the present invention may provide power plugs that function in a highly reliable manner. In one embodiment of the present invention, the prong assembly may be formed by injecting an inner mold over portions of the power prongs. An additional overmold may then be formed over the inner mold such that the overmold forms a large portion of the power plug. This molding may provide a durable housing for the power plug such that it may function in a highly reliable manner.

The overmold may further include guard portions around ends of the prongs. In this way, if the power plug is damaged or destroyed such that the clip assembly is dislodged while the prongs remain in an outlet, the prongs are guarded and are less likely to come into human or other type of contact.

An illustrative embodiment of the present invention may provide power plugs that may be reliably manufactured. In one embodiment of the present invention, a contact having a clip portion may be used to form a connection to a power prong. Using this contact may remove the need for wires, as well as the need for soldering or welding in the assembly of the power plugs, thereby increasing reliability and simplifying the manufacturing process.

Another embodiment of the present invention may provide locating or alignment features to aid in assembling the prong assembly and the clip assembly. These alignment features may protect the contacts during assembly, thereby improving yield and reducing defects. In one specific embodiment of the present invention, tabs located on the clip assembly are arranged to fit in specific openings in the overmold. When the tabs one the clip are aligned with these openings, ends of the power prongs in the prong assembly are aligned with clip portions of the contacts on the clip assembly.

An illustrative embodiment of the present invention may provide power plugs that may have a desirable appearance. In a specific embodiment of the present invention, an inner mold may include a central passage. This central passage may be used as a pathway for a nozzle to inject material for an overmold over the inner mold. Injecting the overmold from front-to-back in this way greatly reduces the occurrence of seams and other artifacts due to the flow of material during the injection of the overmold.

An illustrative embodiment of the present invention may provide a power plug that includes a prong assembly and a clip assembly. The prong assembly may include a plurality of power prongs, an inner mold formed over central sections of the prongs, and an overmold around the inner mold. The clip assembly may include a plurality of contacts each having a clip portion to accept an end of one of the plurality of power prongs, a contact holder to support the plurality of contacts, and a clip to support the contact holder.

An illustrative embodiment of the present invention may provide a method of assembling a power plug. This method may include forming a prong assembly and forming a clip assembly. The prong assembly may be formed by receiving a plurality of power prongs, forming an inner mold over central portions of the power prongs, and forming an overmold over the inner mold. The clip assembly may be formed by receiving a plurality of contacts each having a clip portion to accept an end of one of the plurality of power prongs, placing the contacts on a contact holder, and inserting the contact holder in a clip.

Various materials may be used in the manufacturing of power plugs according to embodiments of the present invention. The contacts and prongs may be formed using stainless steel, copper, copper titanium, phosphor bronze, nickel, or other appropriate material, and they may be plated with copper, nickel, palladium, gold, or other appropriate material.

The clip, contact support, inner mold, and overmold may be formed of silicon or silicone, rubber, hard rubber, plastic, nylon, liquid-crystal polymers (LCPs), polycarbonates, or other nonconductive material or combination of materials. Power plugs consistent with embodiments of the present invention may provide portions of power paths through power adapters for electronic devices such as portable computers, laptops, tablets, desktops, all-in-one computers, cell phones, smart phones, media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

BRIEF DESCRIPTIONS OF THE DRAWINGS

Figure 3:
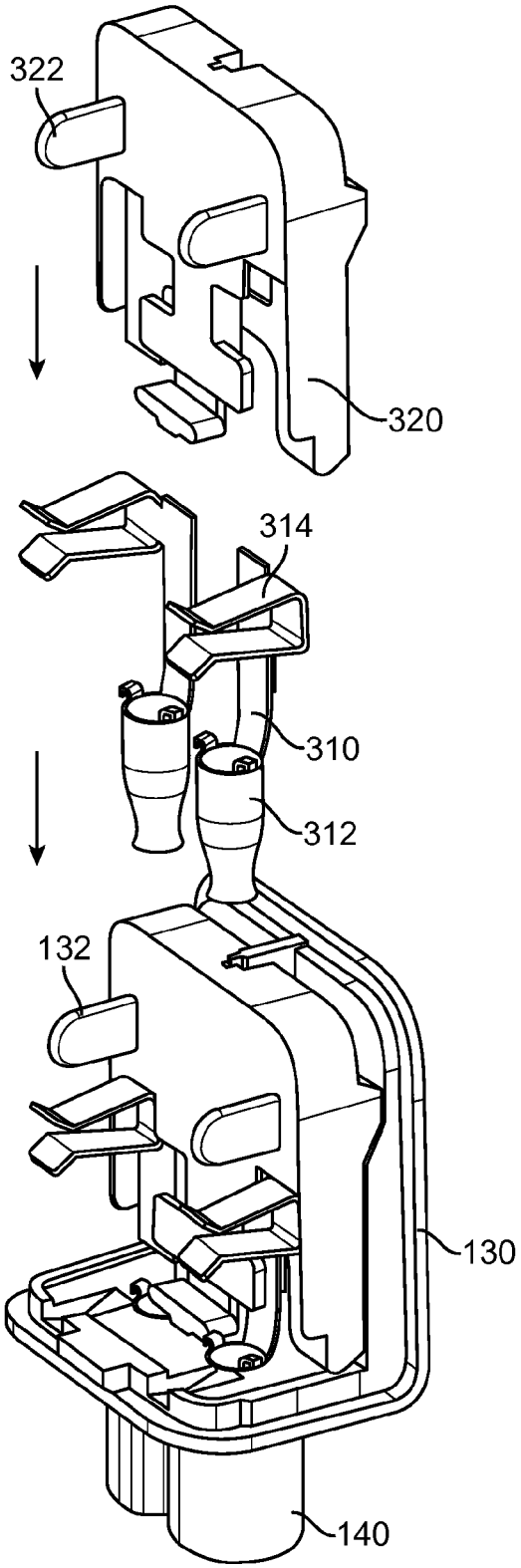
FIG. 3 illustrates a clip assembly according to an embodiment of the present invention.
Figure 8:
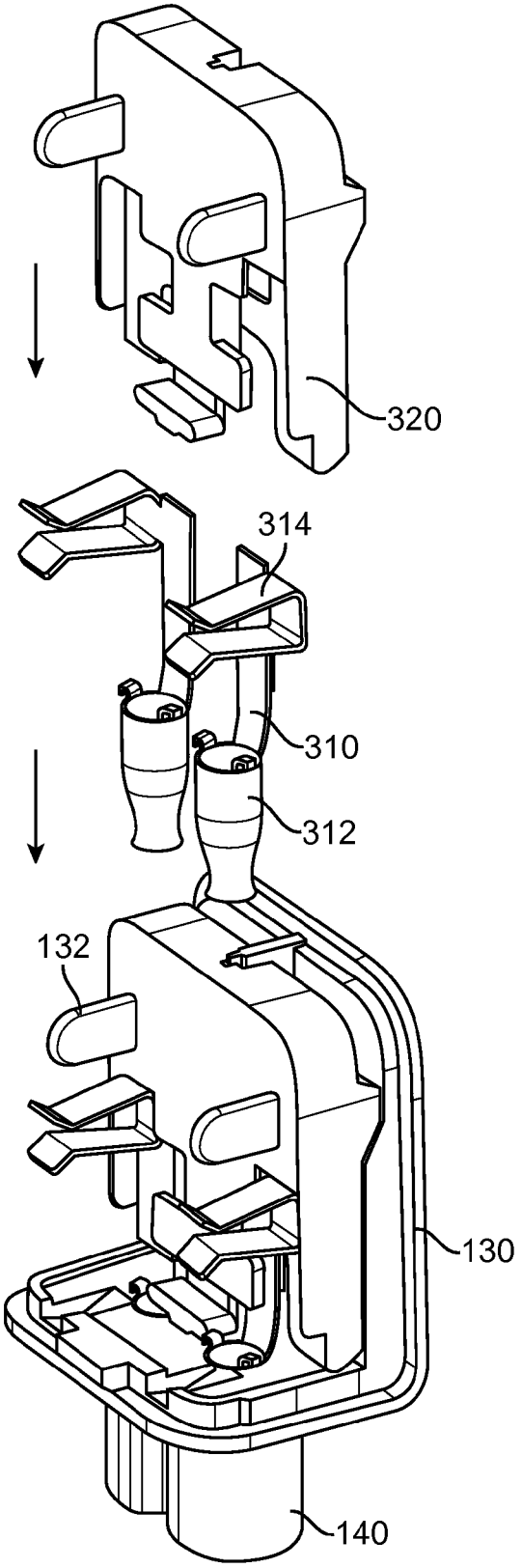
Figure 9:
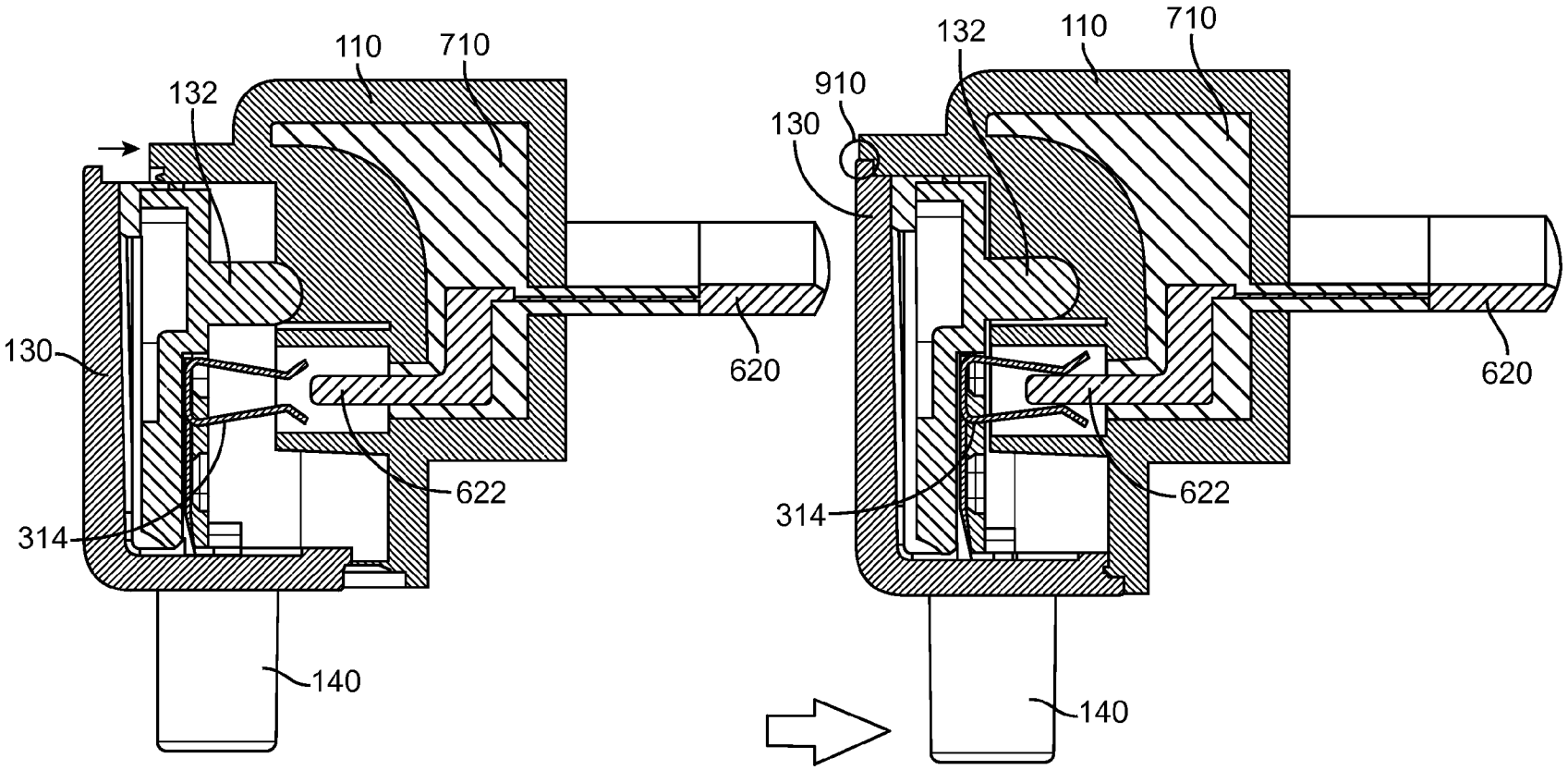
Figure 10:
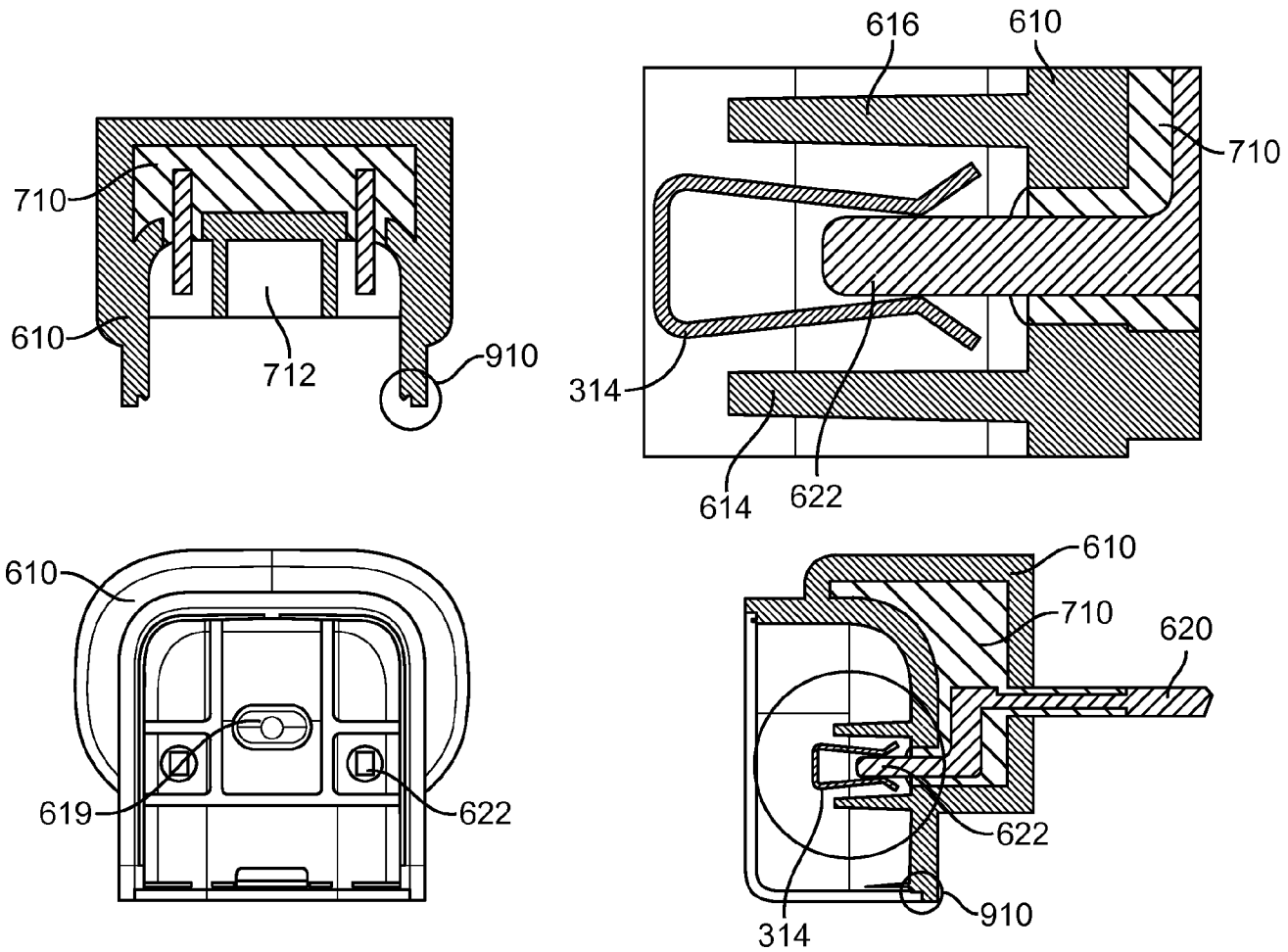

FIG. 8 reiterates the clip assembly from FIG. 3;

FIG. 9 illustrates the assembly of a prong assembly and a clip assembly according to an embodiment of the present invention; and FIG. 10 illustrates details portions of a power plug according to an embodiment of the present invention.

DESCRIPTION OF ILLUSTRATIVE EMBODIMENTS

Figure 1:
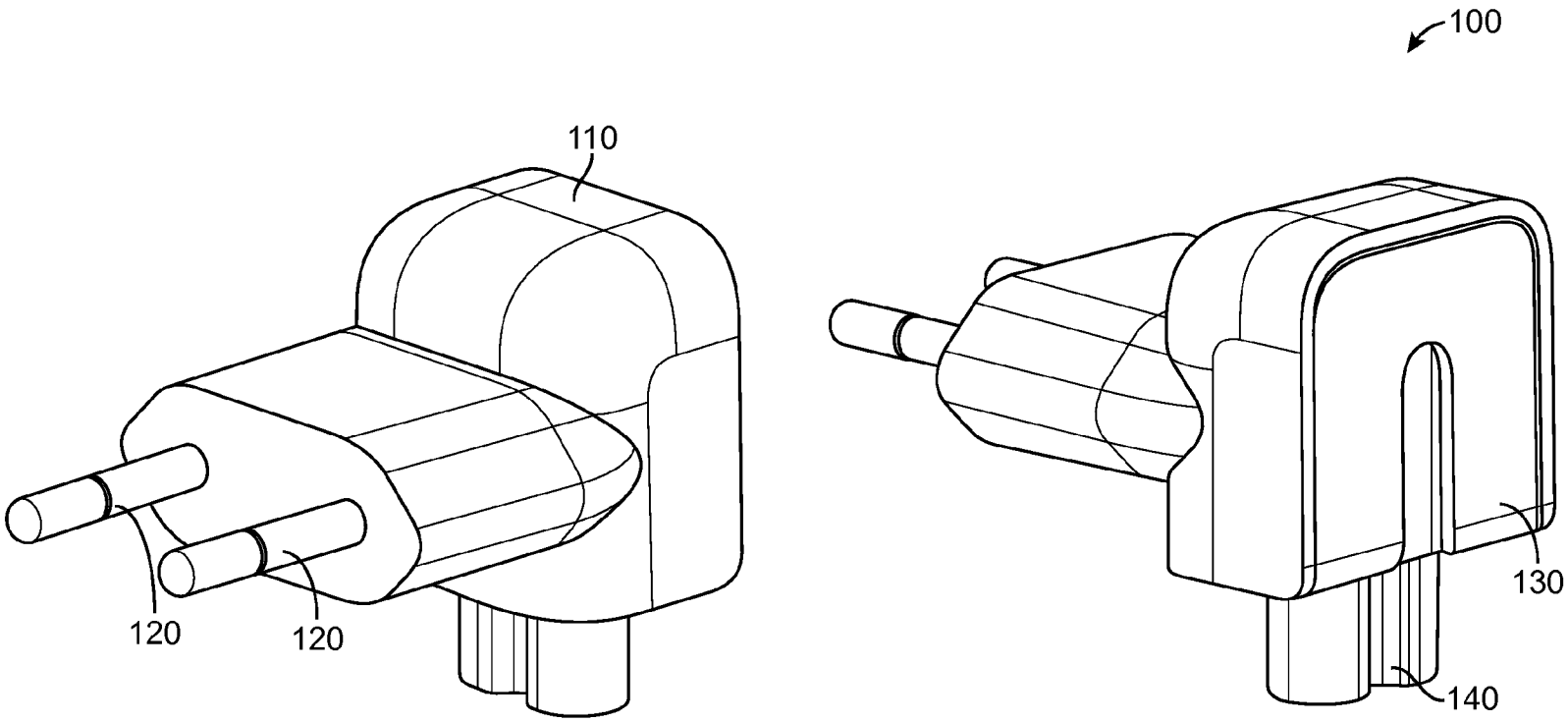
FIG. 1 illustrates oblique views of a power plug consistent with a specific embodiment of the present invention.

FIG. 1 illustrates oblique views of a power plug consistent with a specific embodiment of the present invention. This figure, as with the other included figures, is shown for illustrative purposes only and does not limit either the possible embodiments of the present invention or the claims. Also, the description below may make reference to common reference numbers among different figures. To maintain readability, this is not redundantly pointed for each occurrence.

Power plug 100 may include power prongs 120 which may be electrically connected to contact terminals (not shown) located in clip terminal 140. Clip terminal 140 may fit in an opening in a power adapter. Contact terminals located in clip terminal 140 may form electrical connections with circuitry inside the power adapter. Power received at power prongs 120 may thus be provided to the power adapter. The power adapter may convert power received at prongs 120 and provide the converted power to an electronic device. For example, power prongs 120 may receive power at a first voltage and the power adapter may provide power at a second voltage to the electronic device. The power adapter may also convert AC power to DC power.

Power plug 100 may further include an overmold 110 covering portions of prongs 120 as well as internal electrical connections. Power plug 100 may further include clip 130, which may include clip terminals 140 and may provide support for overmold 110.

By providing a large overmold 110, power plug 100 may be robust, durable, and reliable. Also, embodiments of the present invention may be readily assembled. In various embodiments of the present invention, power plug 100 may include a prong assembly mated to a clip assembly. An example of such a prong assembly is shown in the following figure.

Figure 2:
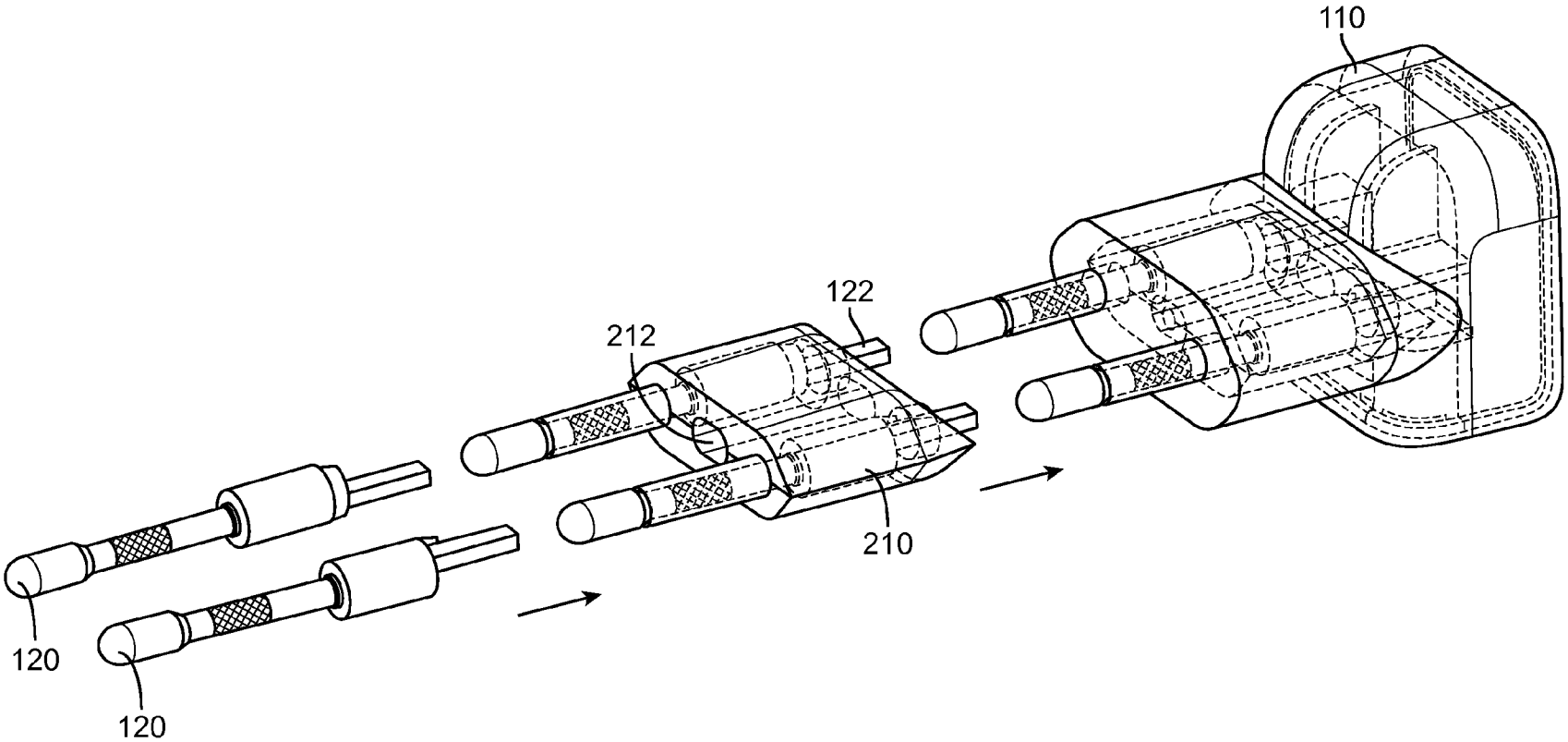
FIG. 2 illustrates a method of manufacturing a prong assembly according to an embodiment of the present invention.

FIG. 2 illustrates a method of manufacturing a prong assembly according to an embodiment of the present invention. Prongs 120 may be made on a lathe, such as numerical controlled lathe. Prongs 120 may be stainless steel copper, or formed of other material. An inner mold 210 may be formed around central portions of prongs 120, leaving we are portions 122 exposed. A central passage 212 may be maintained in inner mold 210. An overmold 110 may be formed over inner mold 210.

Again, embodiments of the present invention may provide power plugs having portions that may be used in power plugs for different regions. In various embodiments of the present invention, a clip assembly may be commonly used among power plugs for different reasons. An example of such a clip assembly is shown in the following figure.

FIG. 3 illustrates a clip assembly according to an embodiment of the present invention. This clip assembly may include contacts 310 having terminal portions 312 and clip portions 314. Contacts 310 may be formed of stamped sheet metal that is bent into shape. Contacts 310 may be formed of stainless steel, copper, or other material. Contact holder 320 may support contacts 310. Contact holder 320 may fit in clip 130 to form a clip assembly.

This prong assembly may then be fitted to the clip assembly to form power plug 100. An example of how this may be done is shown in the following figure.

Figure 4:
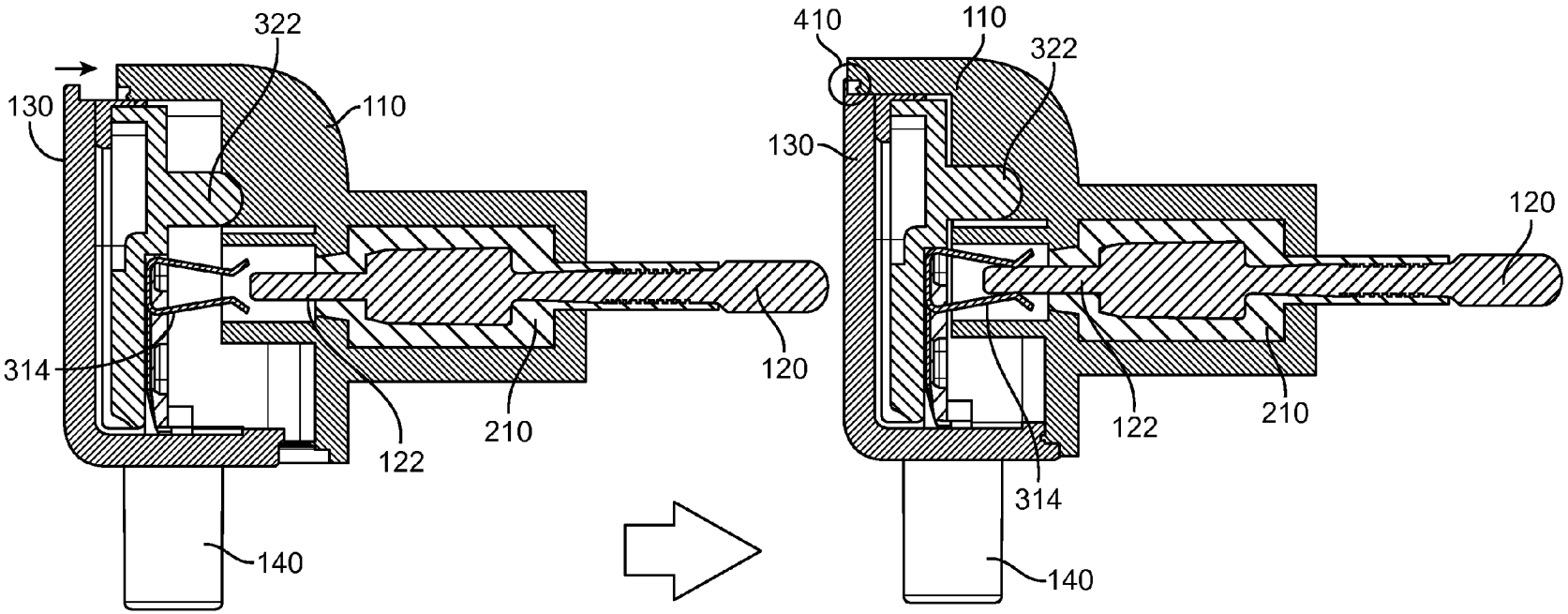
FIG. 4 illustrates the assembly of a prong assembly to a clip assembly according to an embodiment of the present invention.

FIG. 4 illustrates the assembly of a prong assembly to a clip assembly according to an embodiment of the present invention. Prong end 122 may be inserted into clip portion 314 of contacts 310. This connection eliminates the need for internal wires, crimping, soldering, or welding. This in turn may simplify assembly and reduces the number of steps that need to be done by hand.

Specifically, a prong assembly including prong 120, inner mold 210, and overmold 110, may be assembled to a clip assembly including clip 130, contact 310 including clip 314, and clip terminal 140. To ensure proper assembly, contact holder 320 may include locating feature 322. Locating future 322 may be a tab. Overmold 110 may include an opening to allow insertion of tab 322 during assembly. In this way, when tab 322 is aligned to this opening in overmold 110, end 122 of prong 120 may be properly aligned to clip 314 of contacts 310.

In this example, overmold 110 and clip 130 may meet along a seam 410. This seam may include notches such that narrow portions of overmold 110 and clip 130 are formed. After assembly, overmold 110 may be subject to ultrasound vibration. This ultrasound vibration may cause localized heating in these narrow areas, locally melting overmold 110 and forming a seal around the edge of clip 130.

Figure 5:
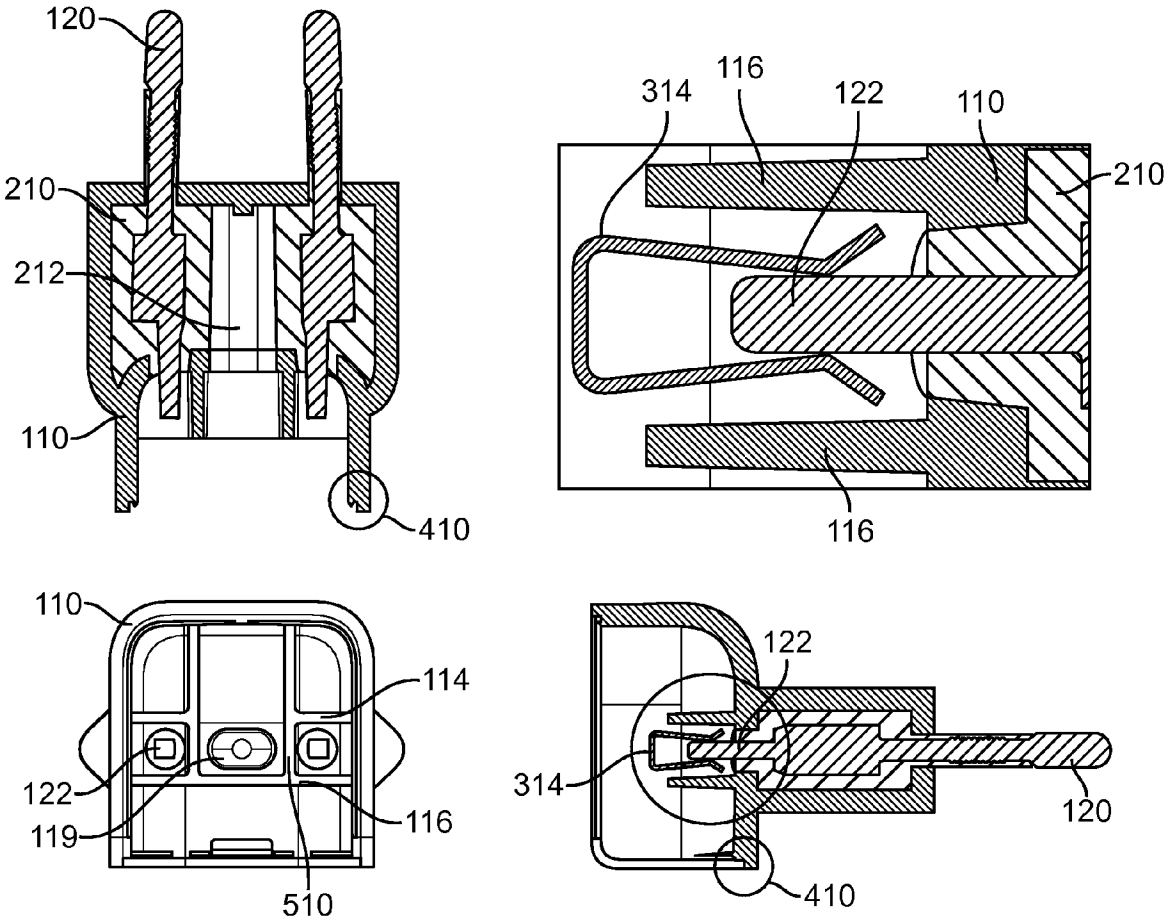
FIG. 5 illustrates details of portions of power plug 100 according to an embodiment of the present invention.

FIG. 5 illustrates details of portions of power plug 100 according to an embodiment of the present invention. Again, inner mold 210 may include central passage 212. Overmold 110 may be formed by inserting a nozzle through central passage 212 to gate location 119. The mold may be injected through gate 119. In this way, overmold 110 may be formed from front to back. By forming overmold 110 in this manner, seams where portions of overmold 110 flow together may be reduced, thereby improving the appearance of power plug 100.

Overmold 110 may include guard portions 116 and 114. In the event that power plug 110 is damaged such that the clip assembly and contacts are removed, ends 122 of prongs 120 may remain protected by guards 114 and 116. By protecting the ends 122 of prongs 120 in this way, even when prongs 120 remaining in an outlet, the chance of human or other contact with prong ends 122 is reduced. Guards 114 and 116 may be portions of guard rings 510.

Again, embodiments of the present invention may provide clip assemblies that may be used for power plugs for different regions. Another such power plugs is shown in the following figures.

Figure 6:
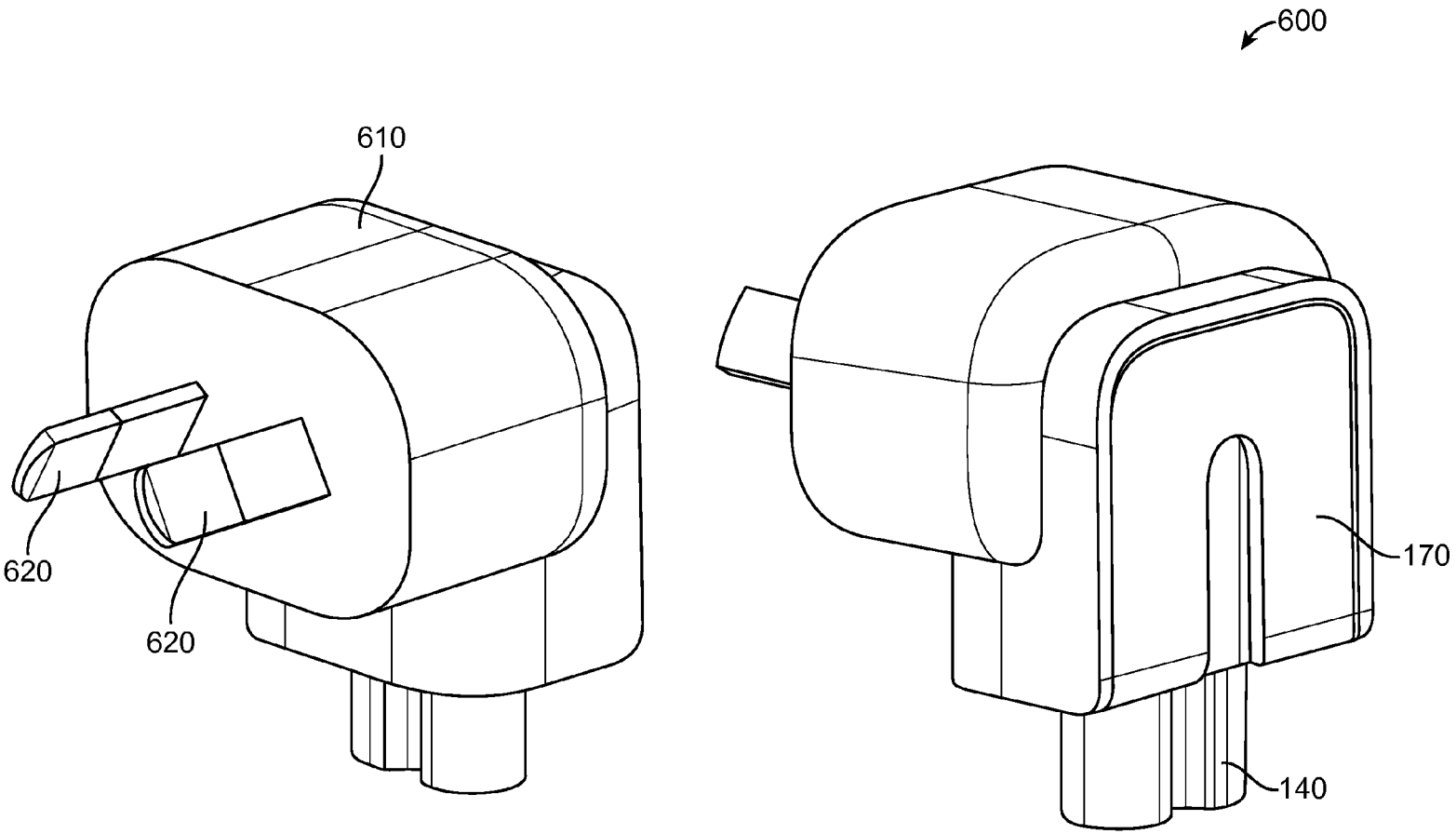
FIG. 6 illustrates front and back oblique views of another power plug according to an embodiment of the present invention.

FIG. 6 illustrates front and back oblique views of another power plug according to an embodiment of the present invention. Power plug 600 may include power prongs 620 located in overmold housing 610, which may be supported by clip 130. Power prongs 620 may form electrical connections with contacts terminals (not shown) located in clip terminal 140. Again, embodiments of the present invention may provide power plugs that may include a prong assembly and a clip assembly. The clip assembly may be the clip assembly above, while prong assemblies may vary depending on region. One such prong assembly is shown in the following figure.

Figure 7:
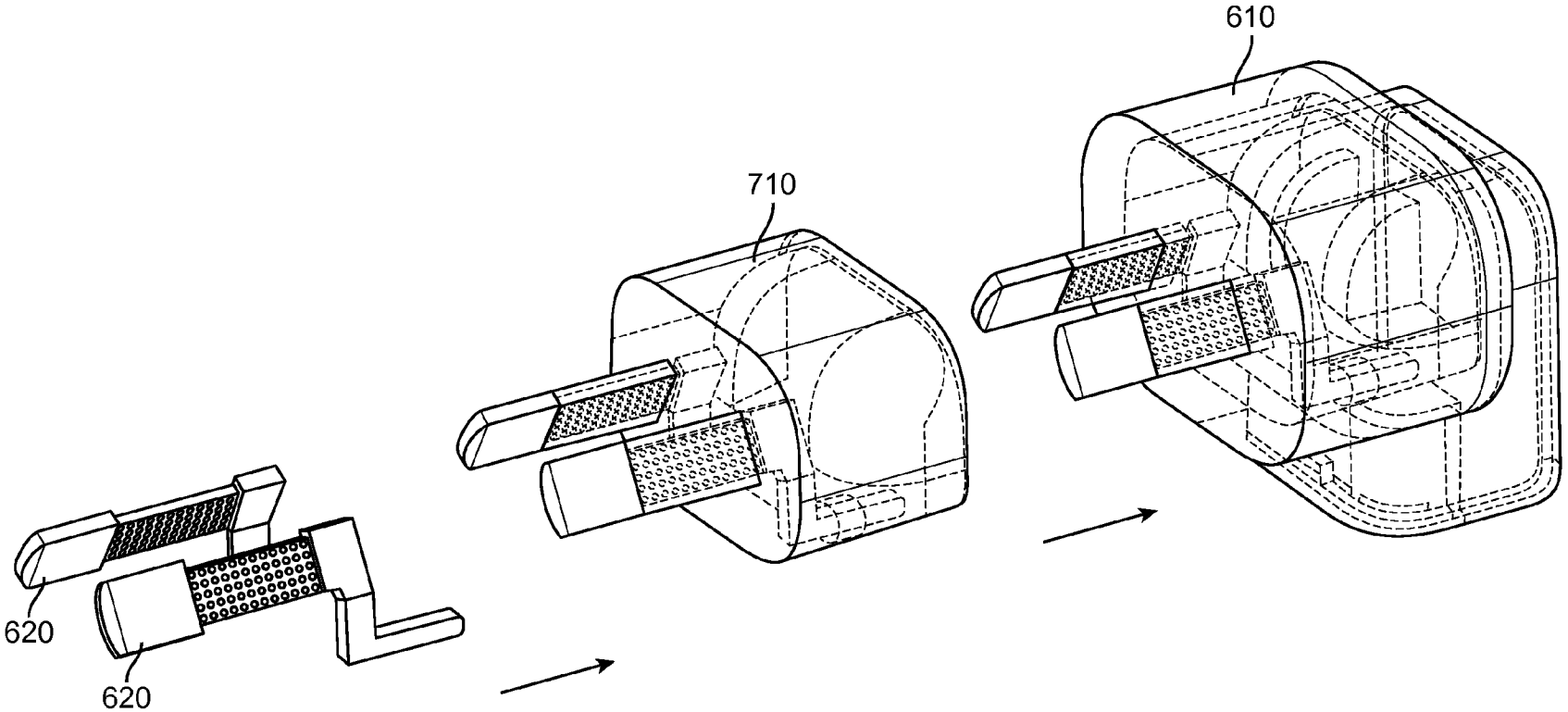
FIG. 7 illustrates another prong assembly according to an embodiment of the present invention.

FIG. 7 illustrates another prong assembly according to an embodiment of the present invention. In this example, two different prongs 620, a right prong and a left prong, are employed. These prongs may be partially encased in inner mold 710. An overmold 610 may be formed around inner mold 710.

Again, the clip assembly for power plug 600 may be the same as the clip assembly for power plug 100. Accordingly, FIG. 8 reiterates the clip assembly from FIG. 3.

Again, power plugs according to embodiments of the present invention may be formed by attaching a prong assembly to a clip assembly. An example is shown in the following figure.

FIG. 9 illustrates the assembly of a prong assembly and a clip assembly according to an embodiment of the present invention. Again, the prong assembly may include inner mold 710, overmold 610, and prongs 620. The clip assembly may include clip 119, contacts 310 including clip 314, and contact holder 320 including tabs 322. Again, tabs 322 may be arranged to fit in openings in overmold 610. When tab 322 is aligned with an opening in overmold 610, an end 622 of prong 620 may be aligned with clip 314 of contact 310.

FIG. 10 illustrates details portions of a power plug according to an embodiment of the present invention. Again, overmold 610 may be injected at gate 619. Guards 614 and 616 may protect ends 622 of prongs 620.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A power plug comprising:
- a prong assembly comprising:
  - a plurality of power prongs;
  - an inner mold formed over central sections of the prongs; and
  - an overmold around the inner mold; and
- a clip assembly comprising:
  - a plurality of contacts each having a clip portion to accept an end of one of the plurality of power prongs;
  - a contact holder to support the plurality of contacts; and
  - a clip to support the contact holder.

2. The power plug of claim 1 wherein the inner mold includes a central passage.

3. The power plug of claim 2 wherein the overmold is formed by injection through a nozzle placed in the central passage of the inner mold.

4. The power plug of claim 1 wherein the clip further comprises a clip terminal to mate with terminals on a power adapter.

5. The power plug of claim 1 wherein the contact holder includes one or more locating features.

6. The power plug of claim 5 wherein the locating features include a tab arranged to fit in an opening in the overmold when the prong assembly is mated to the clip assembly during assembly.

7. The power plug of claim 1 wherein the overmold includes a guard ring to protect an end of one of the plurality of prongs.

8. The power plug of claim 1 wherein an edge of the overmold includes a notched portion to mate with a notched portion on a mating edge of the clip.

9. A method of manufacturing a power plug, the method comprising:
- forming a prong assembly by:
  - receiving a plurality of power prongs;
  - forming an inner mold over central portions of the power prongs; and
  - forming an overmold over the inner mold; and
- forming a clip assembly by:
  - receiving a plurality of contacts each having a clip portion to accept an end of one of the plurality of power prongs;
  - placing the contacts on a contact holder; and
  - inserting the contact holder in a clip.

10. The method of claim 9 wherein the inner mold includes a central passage.

11. The method of claim 10 wherein the overmold is formed by injection through a nozzle placed in the central passage of the inner mold.

12. The method of claim 9 wherein the contact holder includes one or more locating features, the locating features including a tab arranged to fit in an opening in the overmold when the prong assembly is mated to the clip assembly during assembly.

13. The method of claim 9 wherein the overmold includes a guard ring to protect an end of one of the plurality of prongs.

14. The method of claim 9 wherein an edge of the overmold includes a notched portion to mate with a notched portion on a mating edge of the clip.

15. The method of claim 14 where ultrasonic vibration may be used to heat the notched portion of the overmold and the notched portion of the clip to form a seal between the overmold and the clip.

16. A clip assembly for a plurality of power plugs, each power plug compliant with requirements for a different region, the clip assembly comprising:

a plurality of contacts each having a clip portion to accept an end of one of a plurality of power prongs;

a contact holder to support the plurality of contacts, wherein the contact holder includes one or more locating features; and a clip to support the contact holder, wherein the locating features include a tab arranged to fit in an opening in an overmold of a prong assembly when the prong assembly is mated to the clip assembly during assembly.

17. The clip assembly of claim 16 wherein the clip further comprises a clip terminal to mate with terminals on a power adapter.

18. The clip assembly of claim 16 wherein the clips of the contacts form an electrical connection with a plurality of power prongs without soldering or welding.

* * * * *